US008579565B2

(12) United States Patent
Fell

(10) Patent No.: US 8,579,565 B2
(45) Date of Patent: Nov. 12, 2013

(54) PADDED SURFACE TRANSPORTATION APPARATUS FOR CONSTRUCTION EQUIPMENT

(75) Inventor: Randall O. Fell, Campbellsport, WI (US)

(73) Assignee: Marriott Construction, Inc., Waukesha, WI (US)

( * ) Notice: Subject to any disclaimer, the term of this patent is extended or adjusted under 35 U.S.C. 154(b) by 0 days.

(21) Appl. No.: 13/297,298

(22) Filed: Nov. 16, 2011

(65) Prior Publication Data

US 2013/0121784 A1 May 16, 2013

(51) Int. Cl.
*B60P 7/16* (2006.01)

(52) U.S. Cl.
USPC ..... 410/87

(58) Field of Classification Search
USPC ..... 410/87
See application file for complete search history.

(56) References Cited

U.S. PATENT DOCUMENTS

| | | | | |
|---|---|---|---|---|
| 2,018,527 | A * | 10/1935 | Kerr | 280/39 |
| 2,174,415 | A * | 9/1939 | Curtis | 173/187 |
| 2,936,985 | A | 5/1960 | Doerr et al. | |
| 2,956,763 | A | 10/1960 | D'Arca | |
| 3,495,756 | A | 2/1970 | Achermann et al. | |
| 3,620,388 | A | 11/1971 | Mansson | |
| 3,949,878 | A | 4/1976 | Doane | |
| 4,747,495 | A | 5/1988 | Hoss | |
| D302,891 | S * | 8/1989 | Lardell | D34/23 |
| 5,086,750 | A * | 2/1992 | Chiuminatta et al. | 125/13.01 |
| 5,497,708 | A | 3/1996 | Jeruzal | |
| 5,505,140 | A | 4/1996 | Wittmann | |
| 5,593,259 | A | 1/1997 | Kuo | |
| 5,664,394 | A | 9/1997 | Sweeney | |
| 5,755,472 | A | 5/1998 | Clive-Smith | |
| 5,787,817 | A | 8/1998 | Heil | |
| 5,911,179 | A | 6/1999 | Spiczka | |
| 5,970,886 | A | 10/1999 | Knio | |
| 6,109,625 | A * | 8/2000 | Hewitt | 280/43.24 |
| 6,273,081 | B1 * | 8/2001 | Gorgol et al. | 125/13.01 |
| 6,769,368 | B2 | 8/2004 | Underbrink et al. | |
| 7,021,461 | B1 | 4/2006 | Robey | |
| 7,077,067 | B2 | 7/2006 | Bodde et al. | |
| 7,077,374 | B1 | 7/2006 | Johnson | |

(Continued)

FOREIGN PATENT DOCUMENTS

| | | |
|---|---|---|
| DE | 2358893 | 6/1975 |
| DE | 102009008218 | 8/2010 |

(Continued)

OTHER PUBLICATIONS

International Search Report and Written Opinion for Application No. PCT/US2011/061022 dated Jul. 31, 2012 (13 pages).

*Primary Examiner* — H Gutman
(74) *Attorney, Agent, or Firm* — Michael Best & Friedrich LLP

(57) ABSTRACT

A transportation rack for construction equipment is provided. The transportation rack includes a pad for supporting a hard, smooth wheel of the concrete equipment. The pad absorbs dynamic loads on the construction equipment during transportation to avoid flat spots developing on the hard, smooth wheel. The transportation rack also includes a rigid guard to protect a precisely aligned element of the equipment, and a rigid bar extending across a portion of the construction equipment to hold it down or apply a containment load to hold the equipment against the pad.

28 Claims, 8 Drawing Sheets

FIG. 1

(56) References Cited

U.S. PATENT DOCUMENTS

| | | | | |
|---|---|---|---|---|
| 7,648,026 | B2 | 1/2010 | Brittain | |
| 7,845,894 | B2 | 12/2010 | Dickinson et al. | |
| 7,946,458 | B2 | 5/2011 | Joseph | |
| 2003/0047895 | A1* | 3/2003 | McElroy | 280/79.3 |
| 2006/0005685 | A1* | 1/2006 | Lynde | 83/651 |
| 2009/0050031 | A1 | 2/2009 | Cai | |
| 2009/0120906 | A1 | 5/2009 | Grigsby et al. | |
| 2013/0101381 | A1* | 4/2013 | Fell | 414/800 |

FOREIGN PATENT DOCUMENTS

| | | |
|---|---|---|
| JP | 6156495 | 6/1994 |
| JP | 2008239170 | 10/2008 |
| JP | 2011121633 | 6/2011 |

* cited by examiner

PADDED SURFACE TRANSPORTATION APPARATUS FOR CONSTRUCTION EQUIPMENT

BACKGROUND

The present invention relates to a transportation rack that includes a padded surface for protecting the smooth, hard wheels of a piece of construction equipment, such as an early entry saw, during transport.

SUMMARY

In one embodiment, the invention provides a transportation system for construction equipment that includes a smooth, hard wheel that supports the construction equipment during operation and a precisely-aligned element, the smooth wheel being subject to developing a flat spot in response to an external load applied to the construction equipment in excess of a wheel damage threshold, the precisely-aligned element being subject to misalignment in response to an external load applied to the precisely-aligned element in excess of a misalignment threshold, the transportation system comprising: a frame defining a support surface; a pad supported by the support surface of the frame and supporting the smooth wheel of the construction equipment, the pad absorbing a dynamic load arising during transport at least to the extent such dynamic load exceeds the wheel damage threshold; and a rigid guard mounted to the frame for protecting the precisely-aligned element during transport at least to the extent of any impacts in excess of the misalignment threshold; wherein the transportation system is adapted to be loaded on a transporter for transportation of the construction equipment.

In some embodiments, the transportation system further comprises: first and second support struts mounted to the frame on opposite sides of the frame and adapted to extend upwardly on opposite sides of construction equipment supported by the transportation system; and a rigid bar extending between the support struts and adapted to extend across a portion of the construction equipment supported by the transportation system; wherein the rigid bar vertically contains the construction equipment with respect to the frame and limits an amplitude of vertical movement of the construction equipment to limit a dynamic load on the construction equipment arising from transportation of the construction equipment.

In some embodiments, the rigid bar is adapted to extend through a portion of the construction equipment. In some embodiments, the construction equipment includes a drive train for driving the smooth wheel to propel the construction equipment in operation, the drive train being subject to damage in response to an external load applied to the construction equipment in excess of a drive damage threshold; wherein the rigid bar applies a containment load on the construction equipment to hold the smooth wheel in constant contact with the pad during transport; wherein the pad absorbs a combination of the containment load and the dynamic load at least to the extent such combination exceeds the drive damage threshold. In some embodiments, the transportation system further comprises: a ramp pivotally mounted to the frame and movable into a deployed condition to facilitate moving the construction equipment onto the pad and a stowed condition. In some embodiments, the ramp is within the footprint of the frame when in the stowed condition. In some embodiments, the ramp includes a transfer edge adjacent to the pad when the ramp is in the deployed condition to enable the construction equipment to transfer from the ramp to the pad without such transfer causing damage to the smooth, hard wheel. In some embodiments, the transportation system further comprises: a latch for selectively holding the ramp in the stowed condition. In some embodiments, the transportation system further comprises: a lifting device interface adapted to receive portions of a lifting device to facilitate loading and unloading the transportation system onto and off of the transporter. In some embodiments, the lifting device interface includes a pair of tubes, the transportation system further comprising: a pair of inner brace members extending under the pad perpendicular to the first and second tubes and rigidly affixed to the first and second tubes.

The invention also provides a transportation system for construction equipment that includes a smooth wheel that supports the construction equipment during operation, the smooth wheel being subject to developing a flat spot in response to an external load applied to the construction equipment in excess of a wheel damage threshold, the transportation system comprising: a frame defining a support surface; a pad supported by the support surface of the frame and supporting the smooth wheel of the construction equipment, the pad absorbing a dynamic load arising during transport at least to the extent such dynamic load exceeds the wheel damage threshold; first and second support struts mounted to the frame on opposite sides of the frame and adapted to extend upwardly on opposite sides of construction equipment supported by the transportation system; and a rigid bar extending between the support struts and adapted to extend across a portion of the construction equipment supported by the transportation system; wherein the rigid bar vertically contains the construction equipment with respect to the frame and limits an amplitude of vertical movement of the construction equipment; and wherein the transportation system is adapted to be loaded on a transporter for transportation of the construction equipment.

In some embodiments, the rigid bar is adapted to extend through a portion of the construction equipment. In some embodiments, the construction equipment includes a drive train for driving the smooth wheel to propel the construction equipment in operation, the drive train being subject to damage in response to an external load applied to the construction equipment in excess of a drive damage threshold; wherein the rigid bar applies a containment load on the construction equipment to hold the smooth wheel in constant contact with the pad during transport; wherein the pad absorbs a combination of the containment load and the dynamic load at least to the extent such combination exceeds the drive damage threshold. In some embodiments, the construction equipment includes a precisely aligned implement, the precisely-aligned element being subject to misalignment in response to an external load applied to the precisely-aligned element in excess of a misalignment threshold, the transportation system further comprising: a rigid guard mounted to the frame for protecting the precisely-aligned element during transport at least to the extent of any impacts in excess of the misalignment threshold.

In some embodiments, the transportation system further comprises: a ramp pivotally mounted to the frame and movable into a deployed condition to facilitate moving the construction equipment onto the pad and a stowed condition. In some embodiments, the ramp is within the footprint of the frame when in the stowed condition. In some embodiments, the ramp includes a transfer edge adjacent to the pad when the ramp is in the deployed condition to enable the construction equipment to transfer from the ramp to the pad without such transfer causing damage to the smooth, hard wheel.

In some embodiments, the transportation system further comprises: a latch for selectively holding the ramp in the stowed condition. In some embodiments, the transportation system further comprises: first and second tubes mounted to the frame under the pad and adapted to receive portions of a lifting device to facilitate loading and unloading the transportation system onto and off of the transporter with the lifting device. In some embodiments, the lifting device interface includes a pair of tubes, further comprising: a pair of inner brace members extending under the pad perpendicular to the first and second tubes and rigidly affixed to the first and second tubes.

The invention also provides a method of transporting construction equipment, comprising: providing a piece of construction equipment that includes a smooth wheel that supports the construction equipment during operation, the smooth wheel being subject to developing a flat spot in response to an external load applied to the construction equipment in excess of a wheel damage threshold; providing a transportation rack that includes a frame defining a support surface, and a pad supported by the support surface of the frame; positioning the construction equipment on the rack with the pad supporting the smooth wheel; loading the rack bearing the construction equipment on a transporter for transportation of the construction equipment; transporting the construction equipment with the transporter to a desired location; generating a dynamic load on the transportation rack and construction equipment in response to transporting the construction equipment; absorbing the dynamic load with the pad at least to the extent such dynamic load exceeds the wheel damage threshold.

In some embodiments, providing a piece of construction equipment includes providing a piece of construction equipment that further includes a precisely-aligned element, the precisely-aligned element being subject to misalignment in response to an external load applied to the precisely-aligned element in excess of a misalignment threshold; wherein providing a transportation rack includes mounting a rigid guard to the frame; wherein positioning the construction equipment on the rack includes positioning the precisely-aligned element proximate the rigid guard; and wherein transporting the construction equipment further includes protecting the precisely-aligned element with the rigid guard during transport at least to the extent of any impacts in excess of the misalignment threshold. In some embodiments, providing a transportation rack includes mounting first and second support struts to the frame on opposite sides of the frame, and providing a rigid bar extendable between the support struts; wherein positioning the construction equipment on the rack includes positioning the construction equipment with the support struts on opposite sides of construction equipment; the method further comprising: extending the rigid bar across a portion of the construction equipment between the support struts; and vertically containing the construction equipment with respect to the frame to limit an amplitude of vertical movement of the construction equipment. In some embodiments, extending the rigid bar across a portion of the construction equipment includes extending the rigid bar through a portion of the construction equipment. In some embodiments, providing a piece of construction equipment includes providing a drive train for driving the smooth wheel to propel the construction equipment in operation, the drive train being subject to damage in response to an external load applied to the construction equipment in excess of a drive damage threshold; wherein extending the rigid bar across a portion of the construction equipment includes applying a containment load on the construction equipment to hold the smooth wheel in constant contact with the pad during transport; and wherein absorbing the dynamic load includes absorbing a combination of the containment load and the dynamic load at least to the extent such combination exceeds the drive damage threshold. In some embodiments, providing a transportation rack includes pivotally mounting a ramp to the frame; wherein positioning the construction equipment on the rack includes pivoting the ramp into a deployed condition to facilitate moving the construction equipment onto the pad, and, after the construction equipment is on the pad, pivoting the ramp into a stowed condition. In some embodiments, pivoting the ramp into a stowed condition includes positioning the ramp within the footprint of the frame. In some embodiments, pivoting the ramp into a deployed condition includes positioning a transfer edge of the ramp adjacent to the pad; the method further comprising rolling the smooth, hard wheel up the ramp, across the transition edge, and onto the pad without causing damage to the smooth, hard wheel. In some embodiments the method further comprises latching the ramp in the stowed condition. In some embodiments, providing a transportation rack includes mounting first and second tubes to the frame under the pad; and wherein loading the rack bearing the construction equipment on a transporter includes inserting portions of a lifting device into the first and second tubes and loading the rack and construction equipment onto the transporter with the lifting device.

Other aspects of the invention will become apparent by consideration of the detailed description and accompanying drawings.

DETAILED DESCRIPTION

Figure 1:
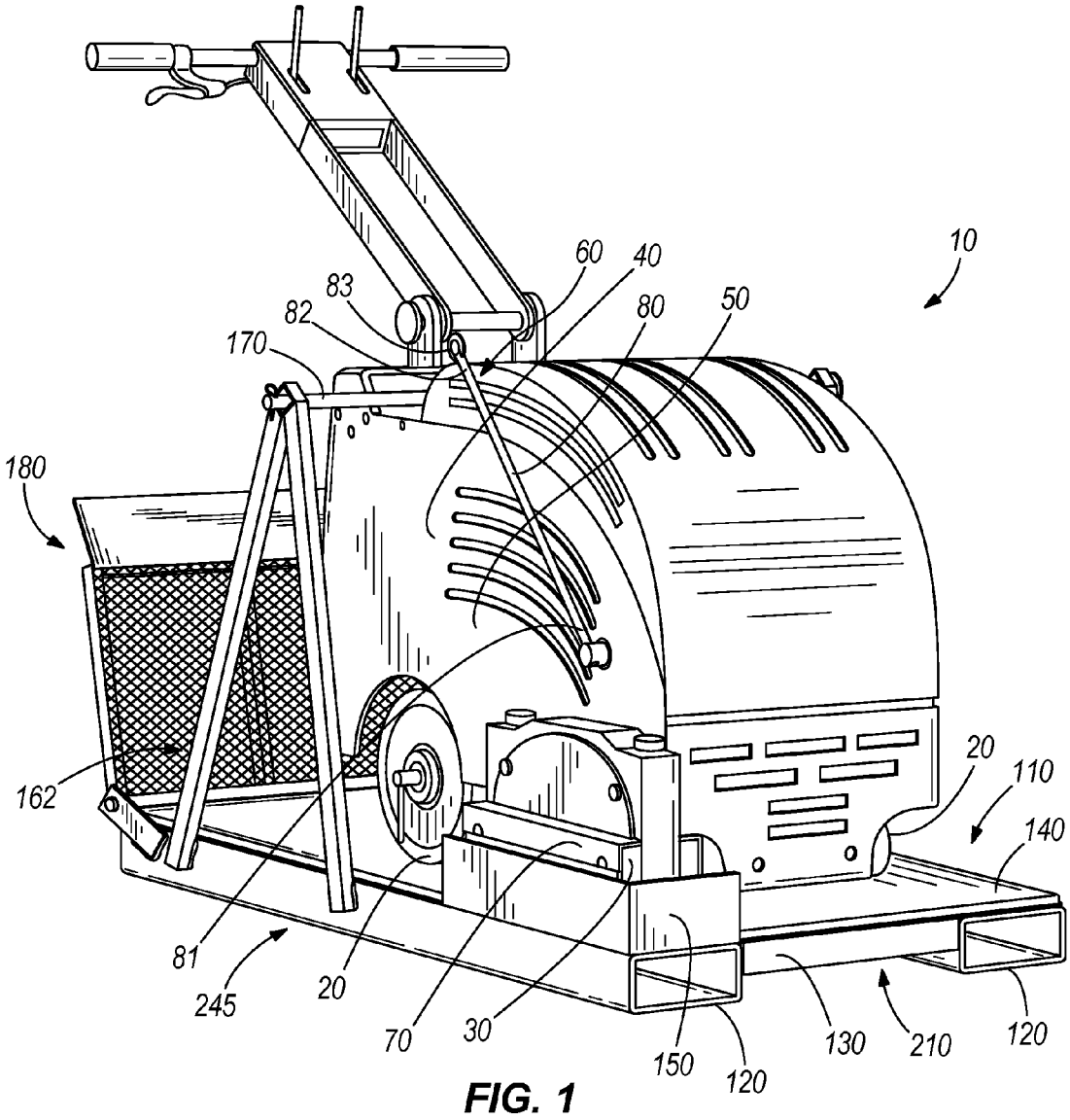
FIG. 1 is a perspective view of a transportation rack according to a first embodiment of the present invention, bearing a piece of construction equipment.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The present invention provides a transportation rack for a piece of construction equipment of a type having a smooth, hard wheel that supports the construction equipment during operation, a precisely-aligned element, a prime mover, and a drive train for driving the smooth wheel under the influence of the prime mover to propel the construction equipment during operation.

The term "hard wheel," as used in the present specification, refers to a wheel that includes a hub constructed of rigid materials, such as steel or other metal. The smooth surface around the hard wheel is provided, for example, by a ring of hard rubber. The hard rubber may be referred to as a tire, but is different from traditional tires in that it is not necessarily inflated and provides a substantially unyielding smooth surface. The term "smooth, hard wheel" is intended to include both the hard wheel and the hard rubber tire around the hard wheel, the resulting combination providing a substantially unyielding smooth round surface on which the construction equipment rides.

The smooth, hard wheel can develop a flat spot in response to an external load being applied to the construction equipment in excess of a wheel damage threshold. The precisely-aligned element can be misaligned in response to an external load applied to the precisely-aligned element in excess of a misalignment threshold. The drive train is subject to damage in response to an external load being applied to the construction equipment in excess of a drive damage threshold. The term "external load" means a load in excess of loads that are present during ordinary operation of the construction equipment. For example, the weight of the construction equipment is a load borne by the smooth wheel during ordinary operation, and would not be an "external load" as that term is used herein.

The term "precisely aligned," as used in this specification, means that successful use of the construction equipment relies on such element being maintained in alignment with respect to another element of the construction equipment. Misalignment of the precisely-aligned element refers to movement of the precisely-aligned element out of alignment with the other element. Should the precisely-aligned element become misaligned, the construction equipment will fail an essential purpose.

An example of a piece of construction equipment for which the transportation rack of the present invention is suitable is a class of concrete saws called "early entry" saws. Early entry saws are adapted to cut a straight line in green-state (i.e., still curing and hardening) concrete. One specific, commercially-available concrete saw of this type is the SOFF-CUT early entry saw manufactured and sold by Husqvarna.

FIG. 1 illustrates an exemplary early entry saw 10. The early entry saw 10 includes a pair of smooth, hard wheels 20, a precisely-aligned element in the form of a cutting blade chuck 30, a prime mover in the form of an electric motor 40, a drive train 50, and a line guide 60. The smooth, hard wheels 20 permit the early entry saw 10 to roll over green-state concrete without marring the smooth surface. A circular cutting blade 70 may be mounted to the cutting blade chuck 30, and the cutting blade chuck 30 and cutting blade 70 are rotated under the influence of the electric motor 40. In other embodiments the prime mover can be an internal combustion engine or any other suitable prime mover. The drive train converts torque of the electric motor into rotation of the smooth, hard wheels.

The line guide 60 includes a bar 80 having a first end 81 pivotably mounted to the right side of the saw 10 and a second end 82 opposite the first end 81, and a disk 83 rotatably mounted to the second end 82 of the bar 80. In operation, the line guide 60 is pivoted into an operational position in which the first end 81 of the bar 80 is in front of the cutting blade chuck 30, and the disk 83 is resting on the concrete to be cut. As the saw 10 moves forward, the disk 83 rolls along the concrete to define a cutting line. The cutting blade chuck 30 is precisely aligned with the line guide 60, such that the saw blade 70 cuts into the concrete a kerf that is collinear with the cutting line. In this regard, the line guide 60 is another element of the early entry saw 10 with which the cutting blade chuck 30 (i.e., the precisely-aligned element) is aligned.

Figure 2:
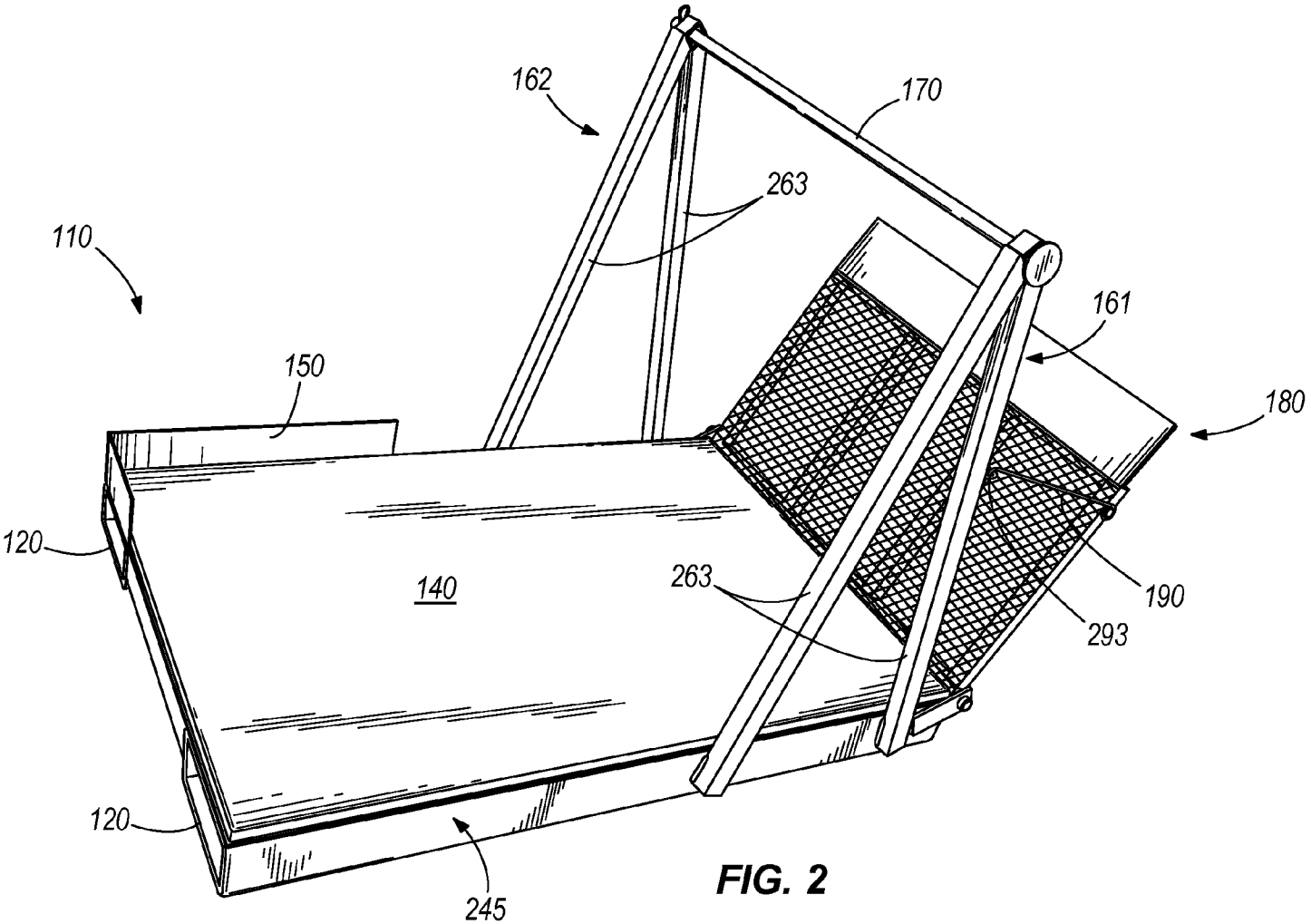
FIG. 2 is a perspective view of the transportation rack of FIG. 1 from another perspective with the construction equipment removed.
Figure 3:
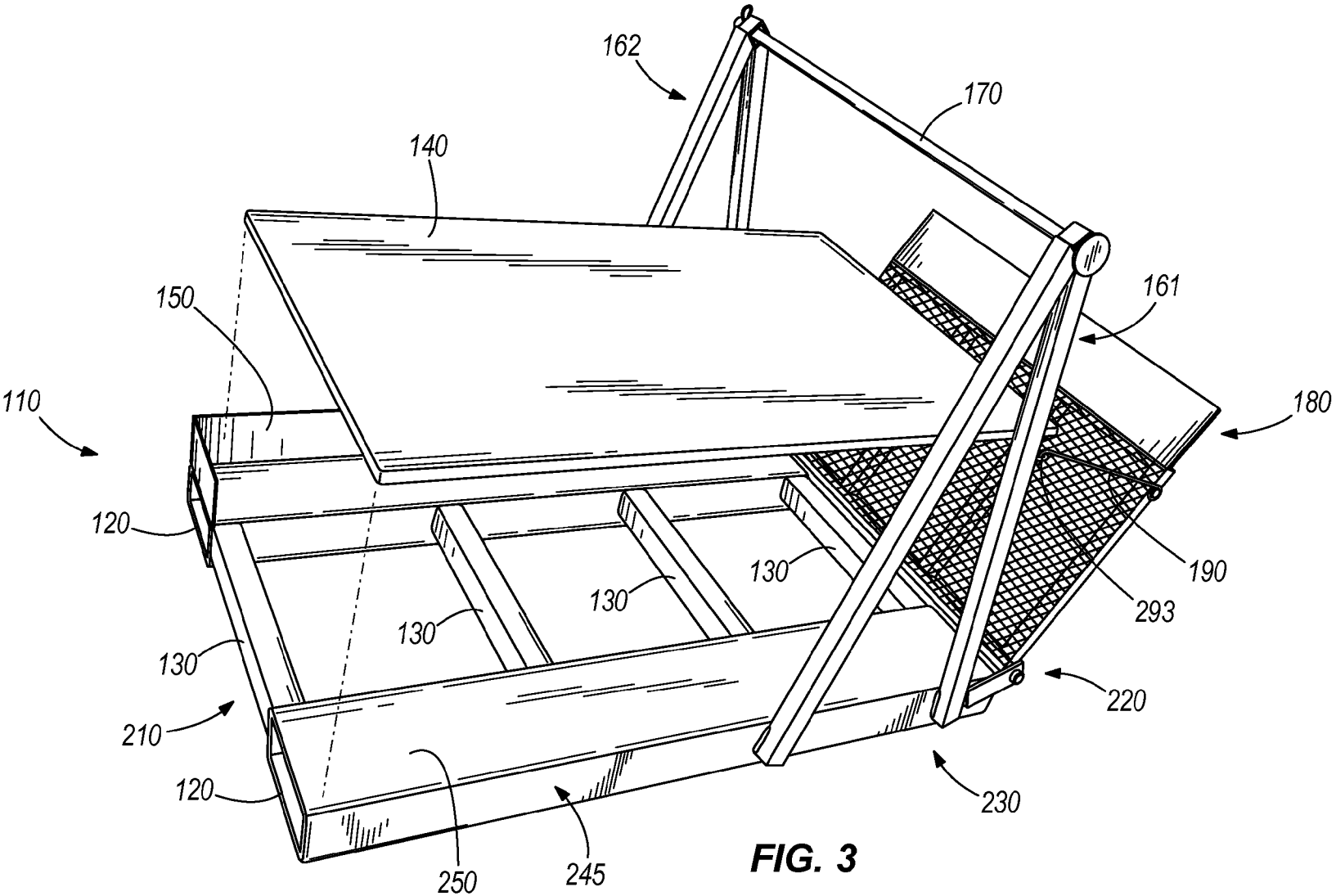
FIG. 3 is a top view of the transportation rack with the pad removed for illustrative purposes.

FIGS. 1-3 illustrate a transportation rack or transportation system 110 for the illustrated early entry saw 10. The transportation system 110 includes a pair of tubes 120, a plurality of inner brace members 130, a pad 140, a rigid guard 150, first and second support struts 161, 162, a rigid bar 170, a ramp 180, and a latch 190.

The pair of tubes 120 extend from a front end 210 of the rack 110 (where the rigid guard 150 is) to a rear end 220 of the rack 110 (wherein the ramp 180 is mounted), and define left and right sides 230, 240 of the rack 110. The plurality of inner brace members 130 extend between the pair of tubes 120 and are rigidly mounted (e.g., as by welding) to the pair of tubes 120. In this regard, the pair of tubes 120 and the inner brace members 130 define a frame 245 for the rack 110. The pair of tubes 120 and inner brace members 130 also define a support surface 250. The pair of tubes 120 define a lifting device interface, as will be discussed below with reference to FIG. 8.

The pad 140 is supported by the support surface 250 of the frame. The pad 140 supports the smooth wheels 20 of the early entry saw 10. In the illustrated embodiment, the pad 140 is about one half inch (½") thick and is constructed of thick rubber. One example of a suitable pad is the ½" Thick Trailer Mat manufactured of recycled materials by Humane Manufacturing Company LLC of Baraboo, Wis.

The rigid guard 150 is mounted to the frame 245 for protecting the cutting blade chuck 30 during transport at least to the extent of any impacts in excess of the misalignment threshold. The rigid guard 150 protects the cutting blade chuck 30 from, for example, debris that fly at the cutting blade chuck 30 during transport, and from any items carelessly thrown into the area where the transportation rack 110 is secured in the transportation vehicle or trailer (collectively, "transporter").

Figure 4:
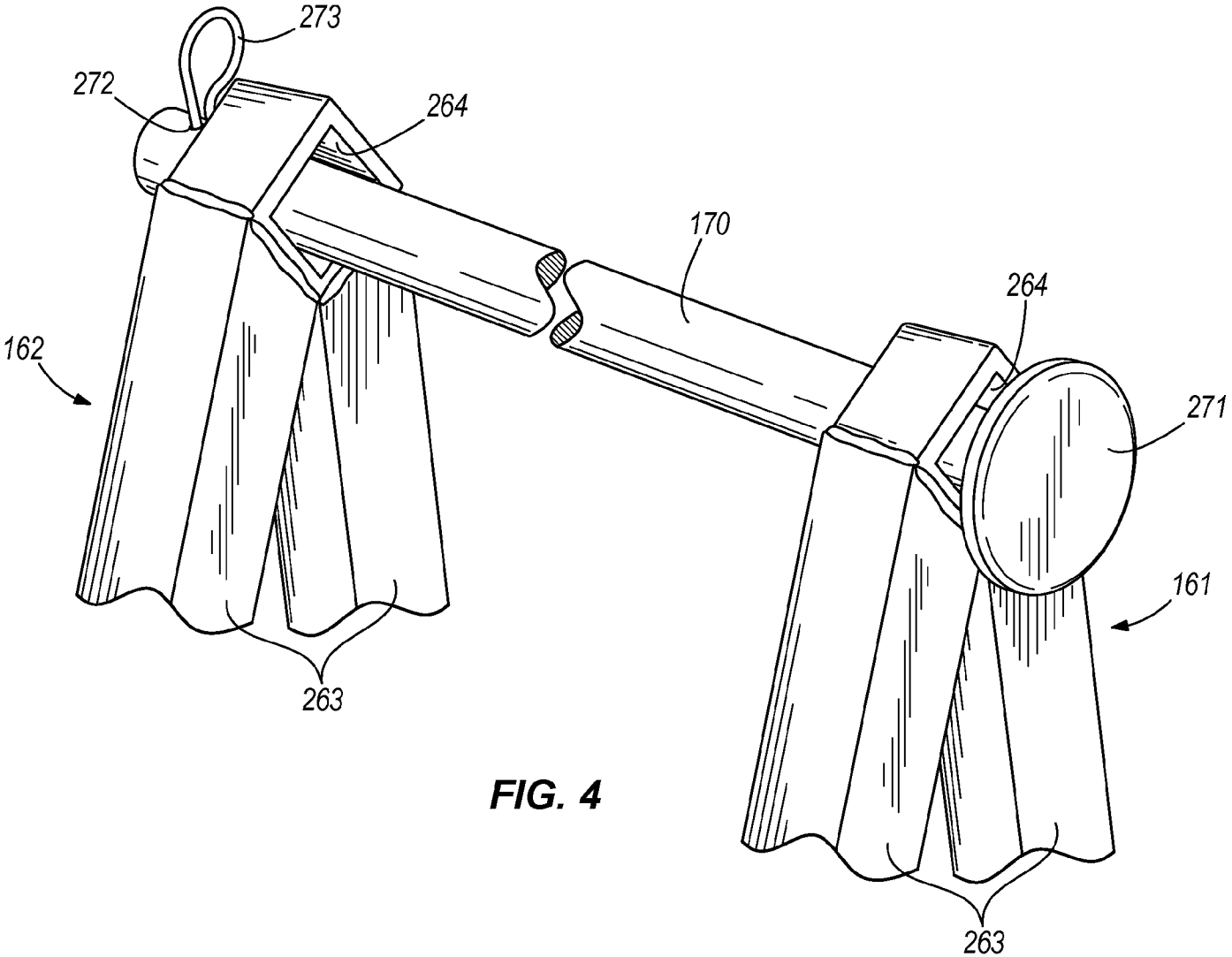
FIG. 4 is an enlarged view of the vertical struts and rigid bar of the transportation rack.

Referring to FIG. 4, the first and second support struts 161, 162 are mounted to opposite sides of the frame 245 and extend upwardly on opposite sides of early entry saw 110. Each support strut 161, 162 includes a pair of legs 263 which define a triangle with the tubes 120, and an aperture 264 where the pair of legs 263 meet at the top of the support struts 161, 162. The rigid bar 170 includes a first end that has an enlarged knob 271 and a second end that includes a retaining hole 272 for accommodating a cotter pin 273 or other retainer. If the arrangement of the early entry saw 10 permits, the rigid bar 170 may extend through a portion of the early entry saw 10.

Figure 5:
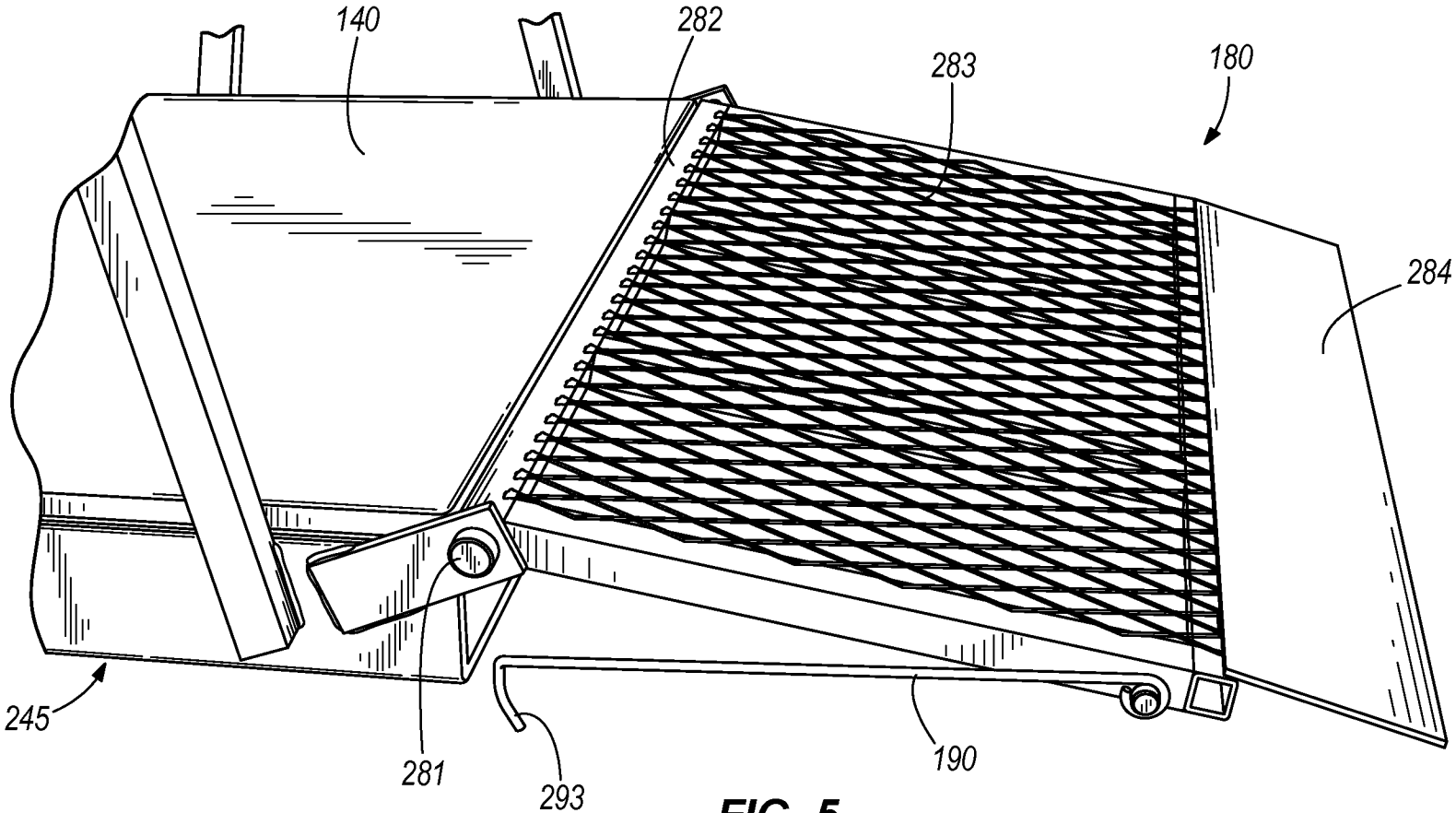
FIG. 5 is an enlarged view of the ramp in a deployed condition.

Referring to FIG. 5, the ramp 180 is pivotally mounted to the frame 245 and movable into a deployed condition to facilitate moving the early entry saw 10 onto the pad 140. The ramp 180 includes a hinge 281, a transfer edge 282, a mesh portion 283, and a rigid lip 284. When in a deployed condition (as illustrated in FIG. 5), the rigid lip 284 contacts the ground and the transfer edge 282 is substantially even with the top of the pad 140 to minimize any gap, drop, or step between the ramp 180 and the pad 140. As a result of the minimal gap, the early entry saw 110 is transferred from the ramp 180 to the pad 140 without causing damage to the smooth, hard wheels 20.

Returning to FIGS. 1-3, the ramp 180 is pivotable into a stowed condition in which the ramp 180 is pivoted up. In some embodiments, the ramp 180 is within the footprint of the frame 245 when in the stowed condition. "Within the footprint" means not extending outside of the vertical projection of the frame 245 (i.e., the projection of the frame 245 defined by vertical planes that include the front 210, rear 220, left 230, and right 240 sides of the frame 245).

As illustrated in FIG. 5, one end of the latch 190 is pivotally mounted to the ramp 180, and the opposite end of the latch 190 includes a hook 291. The latch 190 can be pivoted to engage the hook 291 in an eye 293 (FIGS. 2 and 3) that is mounted to one of the struts 161, 162. When the hook 291 is received in the eye 293, the latch 190 holds the ramp 180 in the stowed condition.

Figure 6:
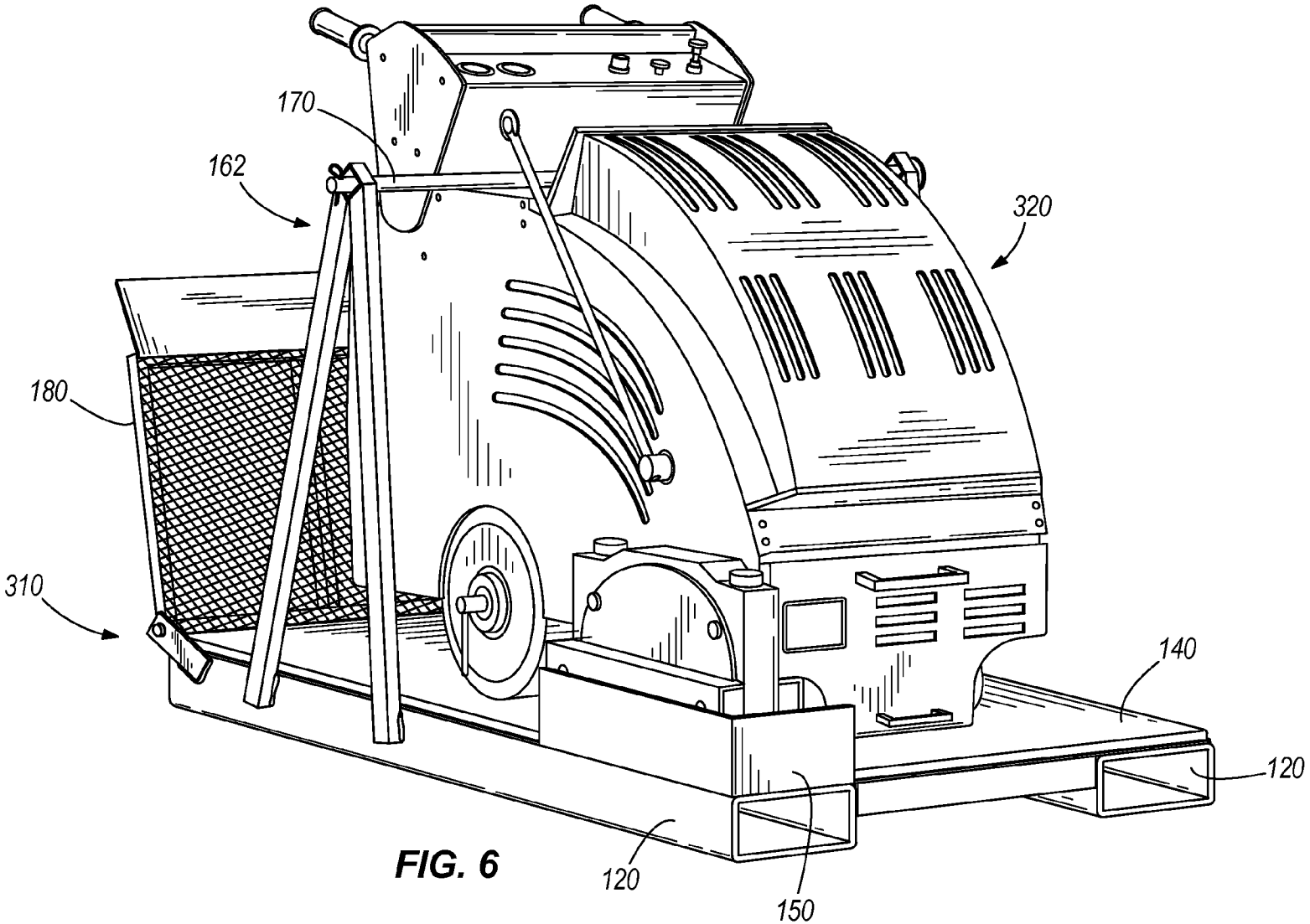
FIG. 6 is a perspective view of a transportation rack according to a second embodiment of the present invention, bearing another piece of construction equipment.
Figure 7:
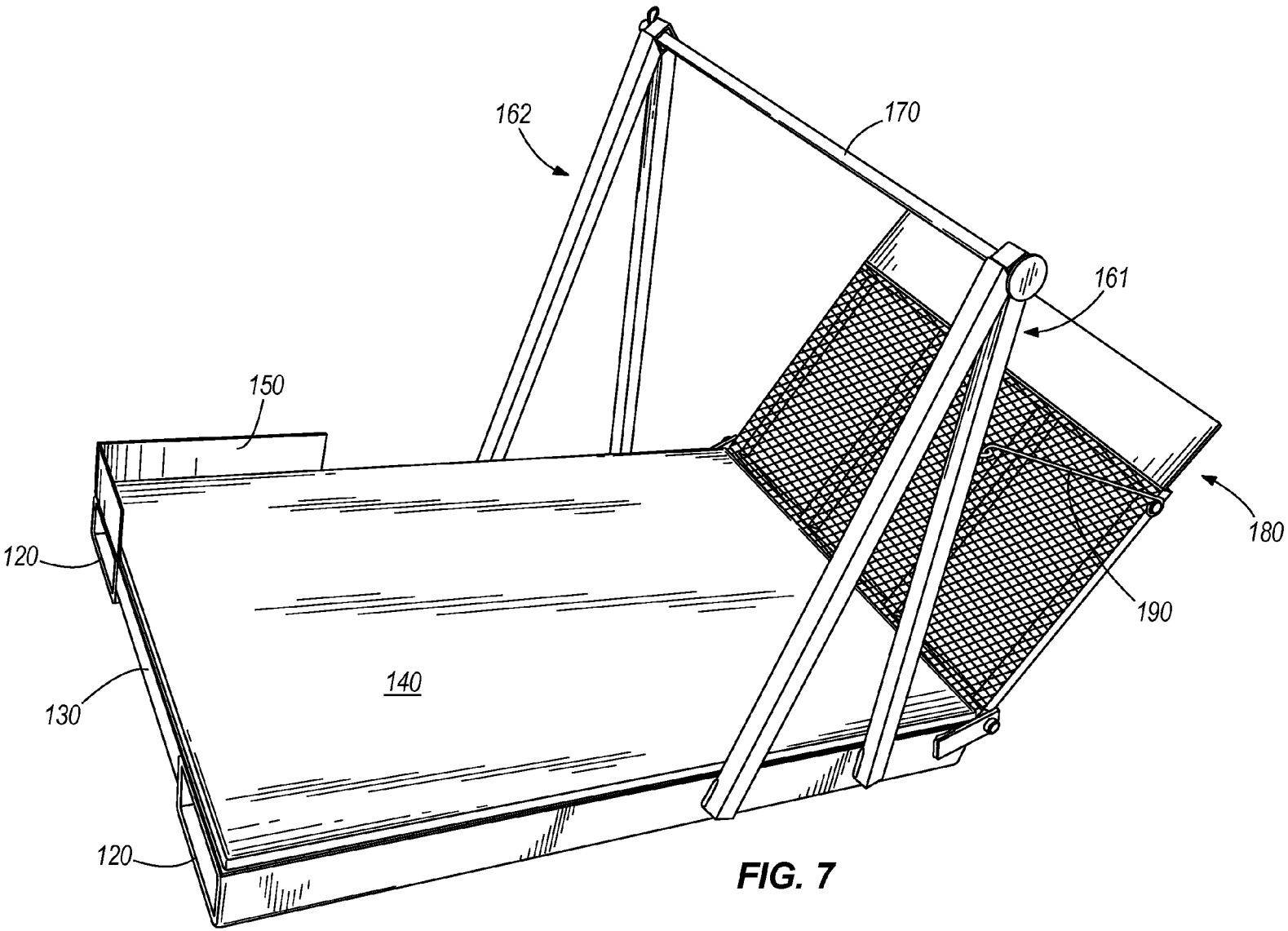
FIG. 7 is a perspective view of the transportation rack of FIG. 6 with the construction equipment removed.

FIGS. 6 and 7 illustrate another embodiment 310 of the transportation rack, but of a larger size to accommodate a larger early entry saw 320. All elements of the embodiment 310 are the same as those of the first embodiment 110, and are labeled as such. In the second embodiment 310, the rack is larger to accommodate the larger early entry saw 320.

Figure 8:
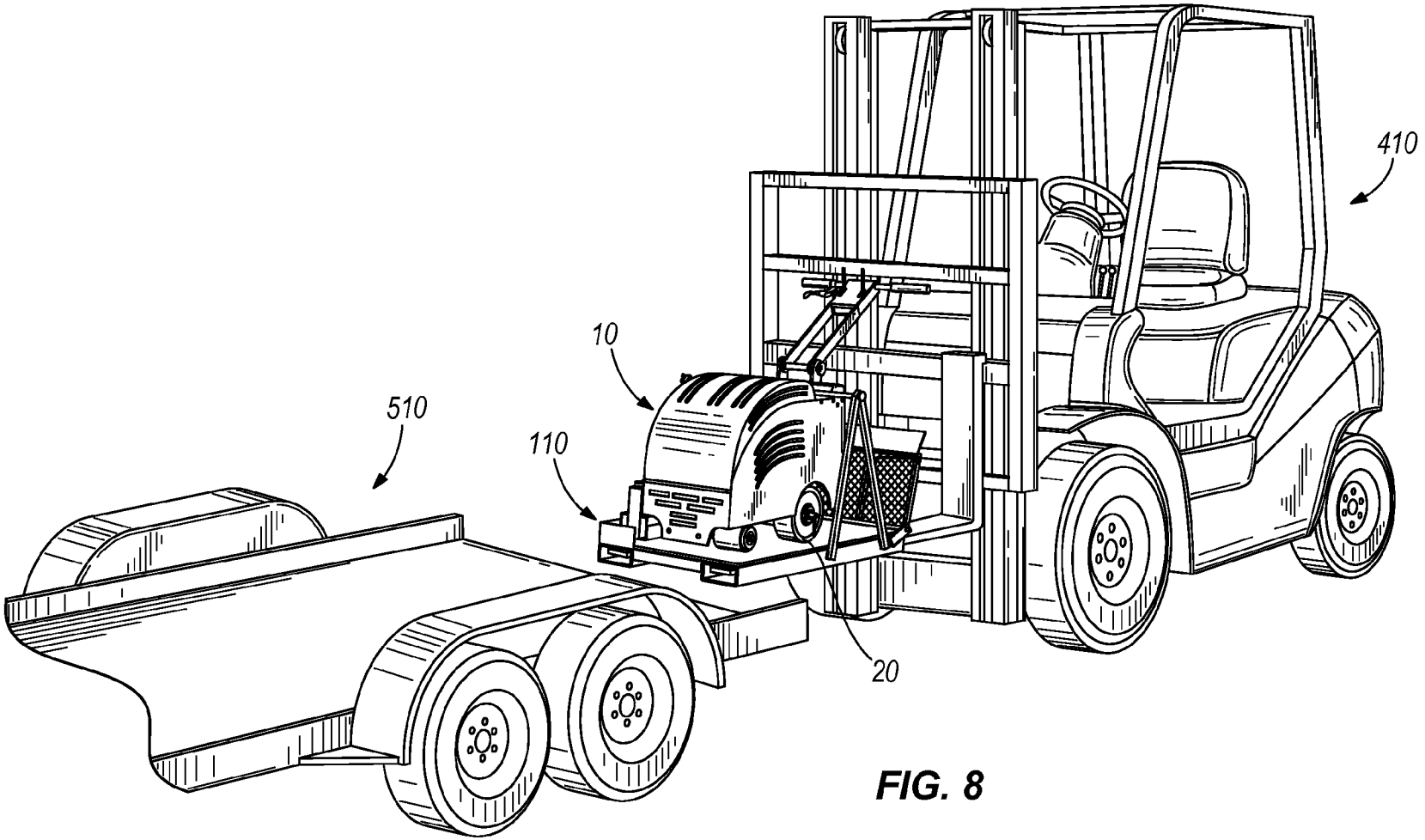
FIG. 8 illustrates a lifting apparatus lifting the transportation rack and construction equipment for deposit into a transporter.

With reference to FIG. 8, the transportation system 110 is adapted to be loaded with a lifting device 410 on a transporter 510 for transportation of the saw 10.

In operation, the ramp 180 of an empty transportation rack 110 is unlatched and pivoted into the deployed condition. The transfer edge 282 of the ramp 180 is positioned adjacent to the pad 140 in response to the ramp 180 being in the deployed condition.

The early entry saw 10 is positioned on the transportation rack 110 by rolling the smooth, hard wheel 20 up the ramp 180, across the transfer edge 282, and onto the pad 140 without causing damage to the smooth, hard wheels 20. The pad 140 supports the smooth wheels 20. The precisely-aligned element 130 is proximate the rigid guard 150. The early entry saw 10 is between the support struts 161, 162, such that the support struts 161, 162 are on opposite sides of early entry saw 10.

The rigid bar 170 is extended between the support struts 161, 162 and secured at opposite ends to the support struts 161, 162. If the early entry saw 10 is so configured, the rigid bar 170 may also extend through a portion of the early entry saw 10 (e.g., a tube permanently affixed to the early entry saw 10).

More specifically, the second end of the rigid bar 170 is extended through the apertures 264 on each of the struts 161, 162, such that the rigid bar 170 extends across (or through, as the case may be) a portion of the early entry saw 10 that is on the transportation rack 110. The enlarged knob 271 of the first end of the rigid bar 170 is too large to pass through the aperture 264 of the first support strut 161. The second end of the rigid bar 170 extends beyond the second strut 162 in cantilever fashion. The retaining pin 273 is inserted through the retaining hole 272 in the second end of the rigid bar 170. The retaining pin 273 is wider than the aperture 264 of the second strut 162, such that the retaining pin 273 resists movement of the second end of the rigid bar 170 back through the aperture 264. In this regard, the rigid bar 170 is retained in the installed condition until the retaining pin 273 is removed to enable the rigid bar 170 to be slid out of the apertures 264 of the struts 161, 162.

The rigid bar 170 vertically contains the early entry saw 10 with respect to the frame 245 and limits an amplitude of vertical movement of the early entry saw 10 to limit a dynamic load on the early entry saw 10 arising from transportation of the early entry saw 10.

The rigid bar 170 may apply a containment load on the early entry saw 10 to hold the smooth wheels 20 in constant contact with the pad 140 during transport. The pad 140 absorbs a combination of the containment load and the dynamic load, to the extent such combination exceeds the wheel damage threshold and drive damage threshold, to protect the smooth, hard wheels 20 and drive train 50 from damage.

The ramp 170 is pivoted into the stowed condition, within the footprint of the frame 245, and latched by inserting the hook 281 of the latch 190 on the eye 293.

Then portions of the lifting device 410 are inserted into the first and second tubes 120, the lifting device 410 lifts the transportation rack 110 bearing the early entry saw 10 and deposits it on the transporter 510 for transportation of the early entry saw 10. Straps or other securing members can be used to lash the transportation rack 110 to the transporter 510, such that the load path of the securing members does not apply any load on the early entry saw 10.

The transporter 510 is used to transport the early entry saw 10 to a desired location. During transport, the dynamic loads are generated on the transportation rack 110 and early entry saw 10. The pad 140 absorbs any dynamic loads and any containment load arising during transport or pushing down by the rigid bar 170, to the extent such loads exceed the wheel damage threshold. As a result, the smooth, hard wheels 140 are protected from developing flat spots that would cause the wheels 120 to skip and mar the smooth surface of the green-state concrete being cut.

The rigid guard 150 protects the cutting blade chuck 130 from impacts during transport. In this regard, the rigid guard 150 protects the cutting blade chuck 130 from becoming misaligned as a result of an impact in excess of the misalignment threshold, because the rigid guard 150 absorbs the impact instead of the cutting blade chuck 130.

Once at a desired site, a lifting device 410 can be used to unload the transportation rack 110 bearing the early entry saw 10 so that the early entry saw 10 can be used in its intended environment.

Thus, the invention provides, among other things, a transportation rack for securing and transporting construction equipment. Various features and advantages of the invention are set forth in the following claims.

What is claimed is:

1. A transportation system with construction equipment comprising:

an early entry saw having a smooth, hard wheel that supports the construction equipment during operation; and a precisely-aligned element, the smooth wheel being subject to developing a flat spot in response to an external load applied to the construction equipment in excess of a wheel damage threshold, the precisely-aligned element being subject to misalignment in response to an external load applied to the precisely-aligned element in excess of a misalignment threshold;

a frame defining a support surface;

a pad supported by the support surface of the frame and supporting the smooth wheel of the construction equipment, the pad absorbing a dynamic load arising during transport at least to the extent such dynamic load exceeds the wheel damage threshold;

a rigid guard mounted to the frame for protecting the precisely-aligned element during transport at least to the extent of an impact in excess of the misalignment threshold; and a lifting device interface adapted to receive portions of a lifting device to facilitate loading and unloading the transportation system onto and off of the transporter;

wherein the transportation system is adapted to be loaded on a transporter for transportation of the construction equipment.

2. The transportation system of claim 1, further comprising:

first and second support struts mounted to the frame on opposite sides of the frame and adapted to extend upwardly on opposite sides of construction equipment supported by the transportation system; and a rigid bar extending between the support struts and adapted to extend across a portion of the construction equipment supported by the transportation system;

wherein the rigid bar limits vertical movement of the construction equipment with respect to the frame and limits an amplitude of vertical movement of the construction equipment to limit a dynamic load on the construction equipment arising from transportation of the construction equipment.

3. The transportation system of claim 2, wherein the rigid bar is adapted to extend through a portion of the construction equipment.

4. The transportation system of claim 2, wherein the construction equipment includes a drive train for driving the smooth wheel to propel the construction equipment in operation, the drive train being subject to damage in response to an external load applied to the construction equipment in excess of a drive damage threshold; wherein the rigid bar applies a containment load on the construction equipment to hold the smooth wheel in constant contact with the pad during transport; wherein the pad absorbs a combination of the containment load and the dynamic load at least to the extent such combination exceeds the drive damage threshold.

5. The transportation system of claim 1, further comprising a ramp pivotally mounted to the frame and movable into a deployed condition to facilitate moving the construction equipment onto the pad and a stowed condition.

6. The transportation system of claim 5, wherein the ramp is within the footprint of the frame when in the stowed condition.

7. The transportation system of claim 5, wherein the ramp includes a transfer edge adjacent to the pad when the ramp is in the deployed condition to enable the construction equipment to transfer from the ramp to the pad without such transfer causing damage to the smooth, hard wheel.

8. The transportation system of claim 5, further comprising a latch for selectively holding the ramp in the stowed condition.

9. The transportation system of claim 1, wherein the lifting device interface includes a pair of tubes, the transportation system further comprising: a pair of inner brace members extending under the pad perpendicular to the first and second tubes and rigidly affixed to the first and second tubes.

10. A transportation system with construction equipment comprising:

an early entry saw having a smooth wheel that supports the construction equipment during operation, the smooth wheel being subject to developing a flat spot in response to an external load applied to the construction equipment in excess of a wheel damage threshold;

a frame defining a support surface;

a pad supported by the support surface of the frame and supporting the smooth wheel of the construction equipment, the pad absorbing a dynamic load arising during transport at least to the extent such dynamic load exceeds the wheel damage threshold;

first and second support struts mounted to the frame on opposite sides of the frame and adapted to extend upwardly on opposite sides of construction equipment supported by the transportation system;

a rigid bar extending between the support struts and adapted to extend across a portion of the construction equipment supported by the transportation system; and a ramp pivotally mounted to the frame and movable into a deployed condition to facilitate moving the construction equipment onto the pad and a stowed condition;

wherein the rigid bar limits vertical movement of vertically contains the construction equipment with respect to the frame and limits an amplitude of vertical movement of the construction equipment; and wherein the transportation system is adapted to be loaded on a transporter for transportation of the construction equipment.

11. The transportation system of claim 10, wherein the rigid bar is adapted to extend through a portion of the construction equipment.

12. The transportation system of claim 10, wherein the construction equipment includes a drive train for driving the smooth wheel to propel the construction equipment in operation, the drive train being subject to damage in response to an external load applied to the construction equipment in excess of a drive damage threshold; wherein the rigid bar applies a containment load on the construction equipment to hold the smooth wheel in constant contact with the pad during transport; wherein the pad absorbs a combination of the containment load and the dynamic load at least to the extent such combination exceeds the drive damage threshold.

13. The transportation system of claim 10, wherein the construction equipment includes a precisely aligned implement, the precisely-aligned implement being subject to misalignment in response to an external load applied to the precisely-aligned implement in excess of a misalignment threshold, the transportation system further comprising: a rigid guard mounted to the frame for protecting the precisely-aligned implement during transport at least to the extent of any impacts in excess of the misalignment threshold.

14. The transportation system of claim 10, wherein the ramp is within the footprint of the frame when in the stowed condition.

15. The transportation system of claim 10, wherein the ramp includes a transfer edge adjacent to the pad when the ramp is in the deployed condition to enable the construction equipment to transfer from the ramp to the pad without such transfer causing damage to the smooth, hard wheel.

16. The transportation system of claim 10, further comprising a latch for selectively holding the ramp in the stowed condition.

17. The transportation system of claim 10, further comprising first and second tubes mounted to the frame under the pad and adapted to receive portions of a lifting device to facilitate loading and unloading the transportation system onto and off of the transporter with the lifting device.

18. The transportation system of claim 17, further comprising a lifting device interface including a pair of tubes and a pair of inner brace members extending under the pad perpendicular to the first and second tubes and rigidly affixed to the first and second tubes.

19. A method of transporting construction equipment, comprising:

providing a piece of construction equipment that includes an early entry saw having a smooth wheel that supports the construction equipment during operation, the smooth wheel being subject to developing a flat spot in response to an external load applied to the construction equipment in excess of a wheel damage threshold;

providing a transportation rack that includes a frame defining a support surface, and a pad supported by the support surface of the frame;

positioning the construction equipment on the rack with the pad supporting the smooth wheel;

loading the rack bearing the construction equipment on a transporter for transportation of the construction equipment;

transporting the construction equipment with the transporter to a desired location;

generating a dynamic load on the transportation rack and construction equipment in response to transporting the construction equipment;

absorbing the dynamic load with the pad at least to the extent such dynamic load exceeds the wheel damage threshold.

20. The method of claim 19, wherein providing a piece of construction equipment includes providing a piece of construction equipment that further includes a precisely-aligned element, the precisely-aligned element being subject to misalignment in response to an external load applied to the precisely-aligned element in excess of a misalignment threshold; wherein providing a transportation rack includes mounting a rigid guard to the frame; wherein positioning the construction equipment on the rack includes positioning the precisely-aligned element proximate the rigid guard; and wherein transporting the construction equipment further includes protecting the precisely-aligned element with the rigid guard during transport at least to the extent of any impacts in excess of the misalignment threshold.

21. The method of claim 19, wherein providing a transportation rack includes mounting first and second support struts to the frame on opposite sides of the frame, and providing a rigid bar extendable between the support struts; wherein positioning the construction equipment on the rack includes positioning the construction equipment with the support struts on opposite sides of construction equipment; the method further comprising: extending the rigid bar across a portion of the construction equipment between the support struts; and vertically containing the construction equipment with respect to the frame to limit an amplitude of vertical movement of the construction equipment.

22. The method of claim 21, wherein extending the rigid bar across a portion of the construction equipment includes extending the rigid bar through a portion of the construction equipment.

23. The method of claim 21, wherein providing a piece of construction equipment includes providing a drive train for driving the smooth wheel to propel the construction equipment in operation, the drive train being subject to damage in response to an external load applied to the construction equipment in excess of a drive damage threshold; wherein extending the rigid bar across a portion of the construction equipment includes applying a containment load on the construction equipment to hold the smooth wheel in constant contact with the pad during transport; and wherein absorbing the dynamic load includes absorbing a combination of the containment load and the dynamic load at least to the extent such combination exceeds the drive damage threshold.

24. The method of claim 19, wherein providing a transportation rack includes pivotally mounting a ramp to the frame; wherein positioning the construction equipment on the rack includes pivoting the ramp into a deployed condition to facilitate moving the construction equipment onto the pad, and, after the construction equipment is on the pad, pivoting the ramp into a stowed condition.

25. The method of claim 24, wherein pivoting the ramp into a stowed condition includes positioning the ramp within the footprint of the frame.

26. The method of claim 24, wherein pivoting the ramp into a deployed condition includes positioning a transfer edge of the ramp adjacent to the pad; the method further comprising rolling the smooth, hard wheel up the ramp, across the transition edge, and onto the pad without causing damage to the smooth, hard wheel.

27. The method of claim 24, further comprising latching the ramp in the stowed condition.

28. The method of claim 19, wherein providing a transportation rack includes mounting first and second tubes to the frame under the pad; and wherein loading the rack bearing the construction equipment on a transporter includes inserting portions of a lifting device into the first and second tubes and loading the rack and construction equipment onto the transporter with the lifting device.

* * * * *